US006135323A

United States Patent [19]

Chen et al.

[11] Patent Number: 6,135,323

[45] Date of Patent: Oct. 24, 2000

[54] DUAL-DISPENSER BOTTLE WITH DUAL-LIQUID ORNAMENT

[76] Inventors: Tsan-Yao Chen, 6F, No. 76, Sec. 3, Hsin Shin N. Road, Taipai; En-Cheng Lin, No. 7, Alley 2, Lane 243, Jen Ho St., Pa Te City, Tao Yuan Hsien, both of Taiwan

[21] Appl. No.: 09/479,626

[22] Filed: Jan. 7, 2000

[51] Int. Cl.[7] ..... B67D 5/52

[52] U.S. Cl. ..... 222/135; 222/321.7

[58] Field of Search ..... 222/78, 135, 321.7, 222/383.1, 482

[56] References Cited

U.S. PATENT DOCUMENTS 5,746,353 5/1998 Cheok et al. ..... 222/135

*Primary Examiner*—Philippe Derakshani

*Attorney, Agent, or Firm*—Dougherty & Troxell

[57] ABSTRACT

A bottle for containing fluid, such as milky lotion, includes a top and a bottom section separated from each other by a middle partition connected to and between them. The top section is integrally formed of two spaced pipes, upper ends of which form two mouths to receive two dispensers, and lower ends of which are tightly joined with two holes on the middle partition to communicate external space with two closed chambers formed in the bottom section. Such bottle can therefore be used to contain two different types of milky lotion at the same time to effectively reduce the number of and the space occupied by bottles in, for example, a toilet room. Moreover, a dual-liquid ornament can be contained in the top section of the bottle to give the same additional value as an ornament. The bottle may have a downward protruded bottom center about which the bottle can be easily turned or swung to cause dynamic changes in the dual-liquid ornament.

3 Claims, 6 Drawing Sheets

DUAL-DISPENSER BOTTLE WITH DUAL-LIQUID ORNAMENT

BACKGROUND OF THE INVENTION

The present invention relates to a bottle with dual-liquid ornament, and more particularly to a bottle having a top section for containing a dual-liquid ornament and a bottom section divided into two chambers for containing two different types of milky lotion that may be sucked out for use via two dispensers provided on the bottle. A downward protruded bottom center of the bottle allows the bottle to be easily turned or swung about the bottom center and thereby causes dynamic changes in the dual-liquid ornament.

The dual-liquid ornament is a conventional and popular ornament. Typically, the dual-liquid ornament includes a closed container in which clear oil and colored water are contained, and one or more preferably three-dimensional floating items are disposed in the container to float between the oil and the water. The dual-liquid ornament has been widely associated with various kinds of articles, such as paperweight and penholder in the early stage and lamp stand, glass bottom, soap case and milky lotion bottle in recent years. For most milky lotion bottles that have dual-liquid ornaments associated therewith, they usually have a single-space clear body provided with one mouth and one lotion dispenser while the dual-liquid ornament is always an additional closed area located in the bottle to show dynamic and changeful views. The following are some of the disadvantages of the conventional milky lotion bottles with dual-liquid ornaments:

1. They are almost the same as any other milky lotion bottles in appearance, except that an additional space for showing the dual-liquid ornament is provided in the bottles. Since the dual-liquid ornament has become a very popular ornament, a general milky lotion bottle with such ornament would no longer strongly attract consumers.
2. They provide only one single space for containing only one type of milky lotion while there are usually many different kinds of lotions needed in our daily life. Therefore, a lot of bottles for different lotions would occupy a large space on a shelf in the toilet room or on a dressing table to cause disorder.
3. Most of them are designed for remaining stationary on the shelf or tabletop. Therefore, the dual-liquid ornament loses its dynamic decoration effect.

SUMMARY OF THE INVENTION

It is therefore a primary object of the present invention to provide a dual-dispenser bottle with dual-liquid ornament. The bottle includes a top section for containing the dual-liquid ornament and a bottom section separated from the top section and divided into two chambers for containing two different types of milky lotion. The top section is internally formed of two spaced pipes, two lower ends of which communicate the bottom chambers with external space. Two dispensers are separately fitted in the two pipes to downward extend into the bottom chambers, so that milky lotions in the bottom chambers can be sucked out via the dispensers for use. Such bottle for containing two different milky lotions effectively reduces the number of and the space occupied by the bottles generally needed in toilet rooms or on dressing tables.

Another object of the present invention is to provide a dual-dispenser bottle with dual-liquid ornament that may have a curved bottom surface with a slightly downward protruded bottom center. The bottle may be easily turned or swung about the protruded bottom center to cause dynamically changed views in the dual-liquid ornament, so that the bottle has increased value as a dynamic ornament.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
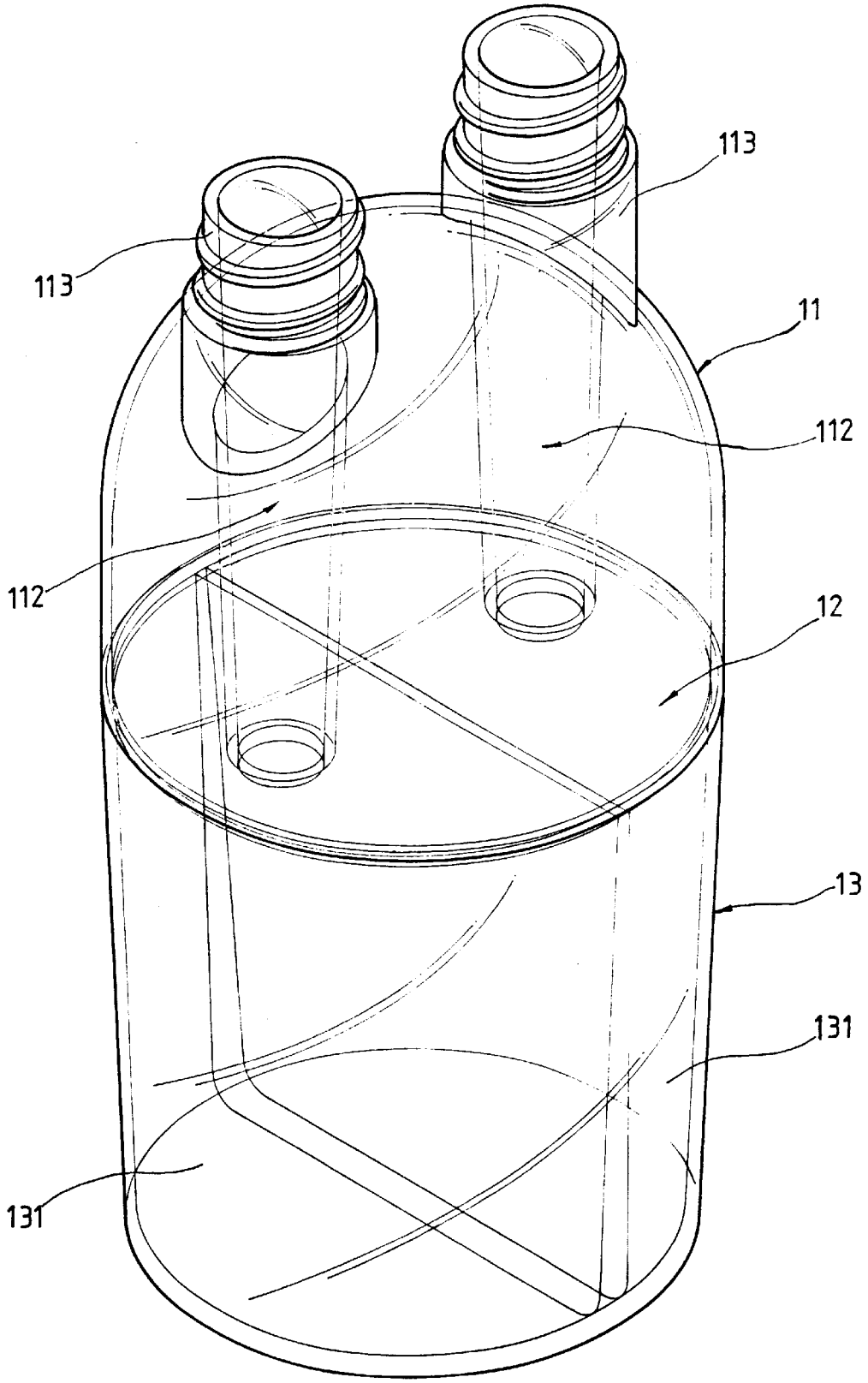
FIG. 1 is a perspective of an empty dual-dispenser bottle according to the present invention with the dispensers and the dual-liquid ornament removed from the bottle.
Figure 3:
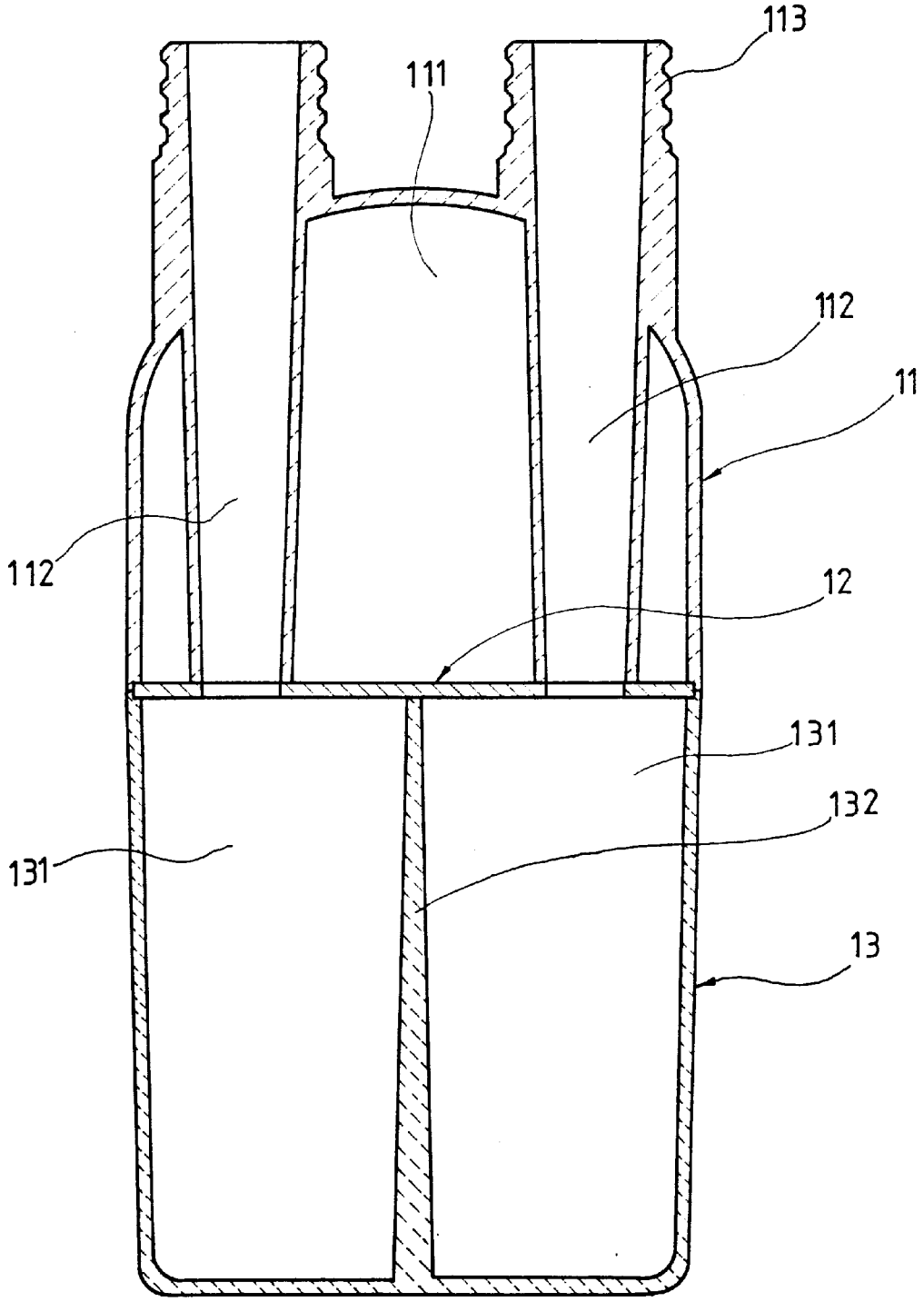
FIG. 3 is a vertical sectional view of the bottle of FIG. 1.
Figure 4:
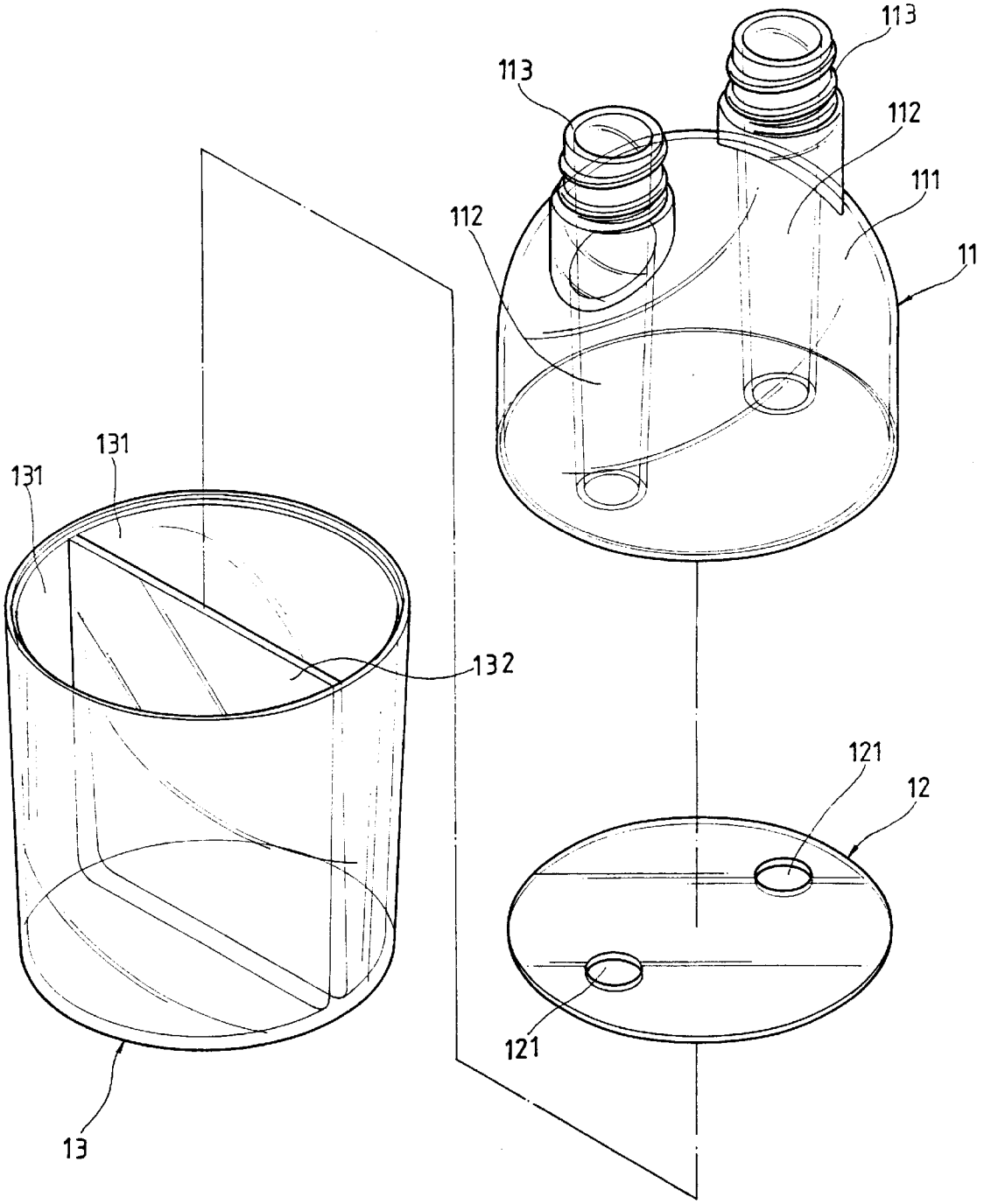
FIG. 4 is an exploded perspective of the bottle of FIG. 1.

Please refer to FIGS. 1, 3 and 4 that are sequentially assembled perspective, vertical sectional, and exploded perspective views of a dual-dispenser bottle 10 according to an embodiment of the present invention. The bottle 10 is divided in vertical direction into two sections, namely, a top section 11 and a bottom section 13, with a middle partition 12 transversely located between the top and the bottom sections 11, 13. The top section 11, the middle partition 12, and the bottom section 13 all may be individually integrally formed from transparent plastic material through injection molding, and the two sections are in the form of hollow shells. By means of supersonic welding, the sections 11, 13 and the middle partition 12 are assembled to form a complete bottle unit.

The top section 11 has an open bottom and defines a first inner space 111 in which two integrally formed and vertically spaced pipes 112 are provided. The pipes 112 have upward projected upper ends to form two preferably externally threaded mouths 113 onto each of which a dispenser 20 (see FIG. 2) is screwed, and lower open ends.

The middle partition 12 includes two spaced holes 121 corresponding to the lower open ends of the two pipes 112 of the top section 11, such that when the middle partition 12 is connected at an upper side to the open bottom of the top section 11 by supersonic welding, the lower open ends of the pipes 112 separately tightly abut on outer peripheries of the holes 121 for the inner space 111 to form a first closed chamber 111 for containing a dual-liquid ornament 30 (see FIG. 2) therein.

Figure 2:
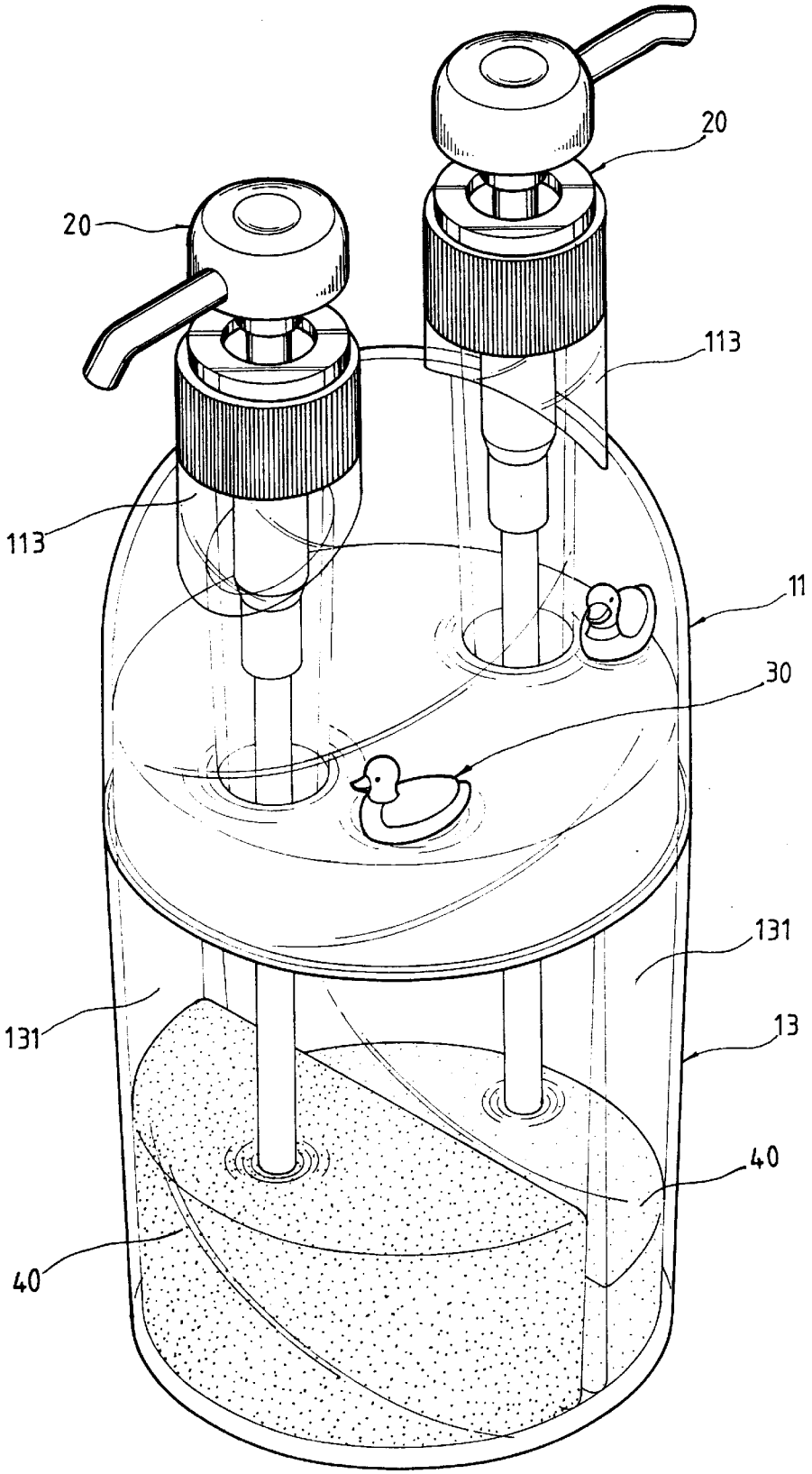
FIG. 2 shows the bottle of FIG. 1 having two dispensers fitted therein and containing the dual-liquid ornament and two different types of milky lotion for use.

The bottom section 13 has an open top and defines a second inner space in which a vertical partition 132 is provided to divide the second inner space into two smaller spaces 131, such that when the bottom section 13 is supersonically welded at its open top to a bottom side of the middle partition 12, a top of the vertical partition 132 can also be welded to the middle partition 12 for the two smaller spaces 131 to form two second closed chambers 131 into which two different types of milky lotion 40 may be contained (see FIG. 2). The second closed chambers 131 of the bottom section 13 communicate with external space via the holes 121 on the middle partition 12 and the pipes 112.

The milky lotions 40 in the two chambers 131 maybe dispensed for use via the dispensers 20 fitted in the pipes 121 via the mouths 113. By containing two different milky lotions 40 in the same one bottle 10, the number of and the space occupied by bottles in a toilet room or on a dressing table can be effectively reduced.

Figure 5:
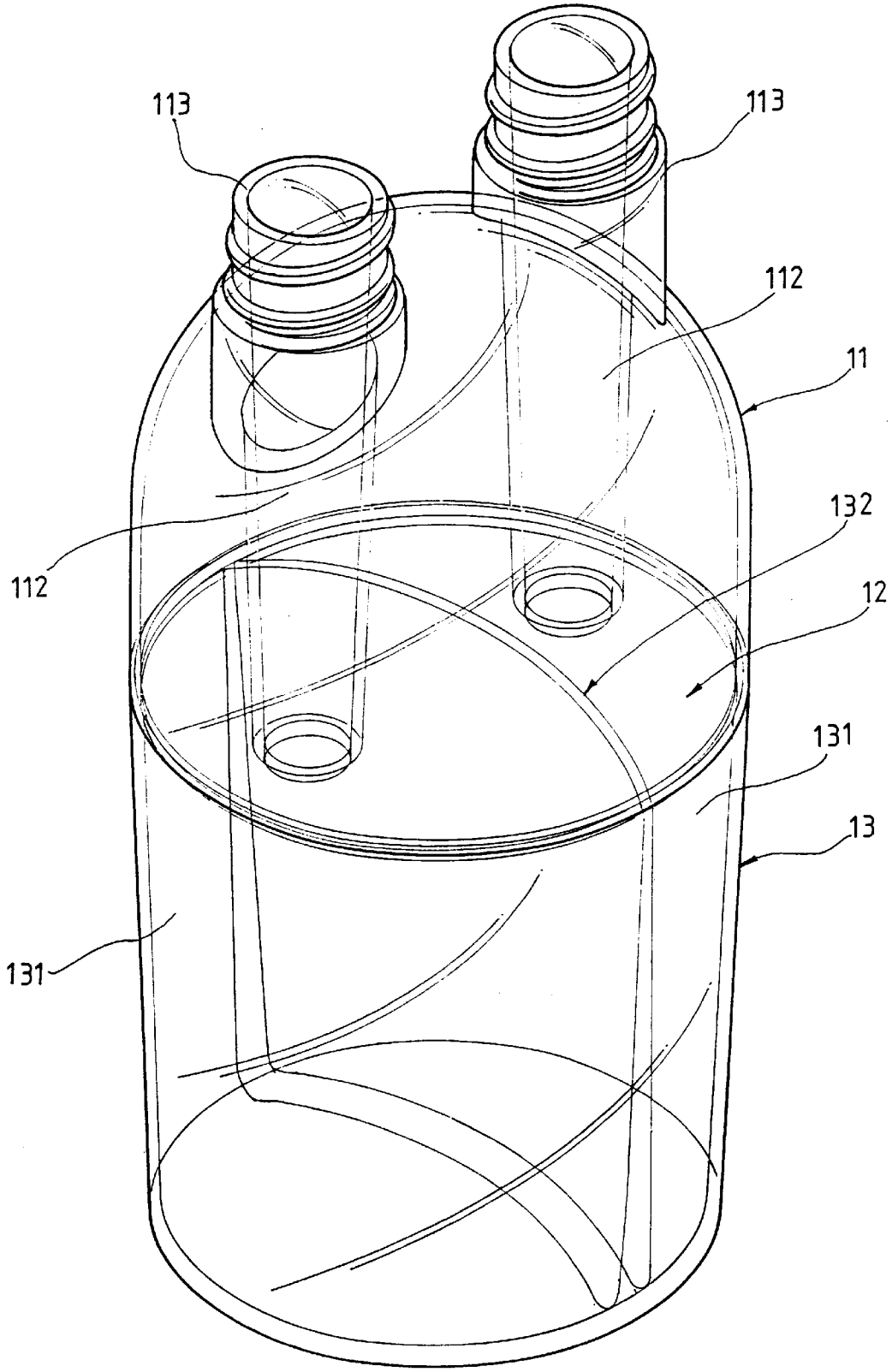
FIG. 5 is a perspective of an empty dual-dispenser bottle according to another embodiment of the present invention.

It is to be noted that the bottle 10 is not necessarily formed through injection molding and is not limited to any specific design or shape. For instance, the top and the bottom sections 11, 13 may have different heights, the middle partition 12 may be otherwise slightly inclined, and the pipes 112 may have different diameters or locations. That is, the whole bottle 10 may be designed completely depending on market demands and produced by making suitable molds. FIG. 5 illustrates another embodiment of the present invention in which the vertical partition 132 is a curved member instead of a straight member as that shown in FIG. 1.

Figure 6:
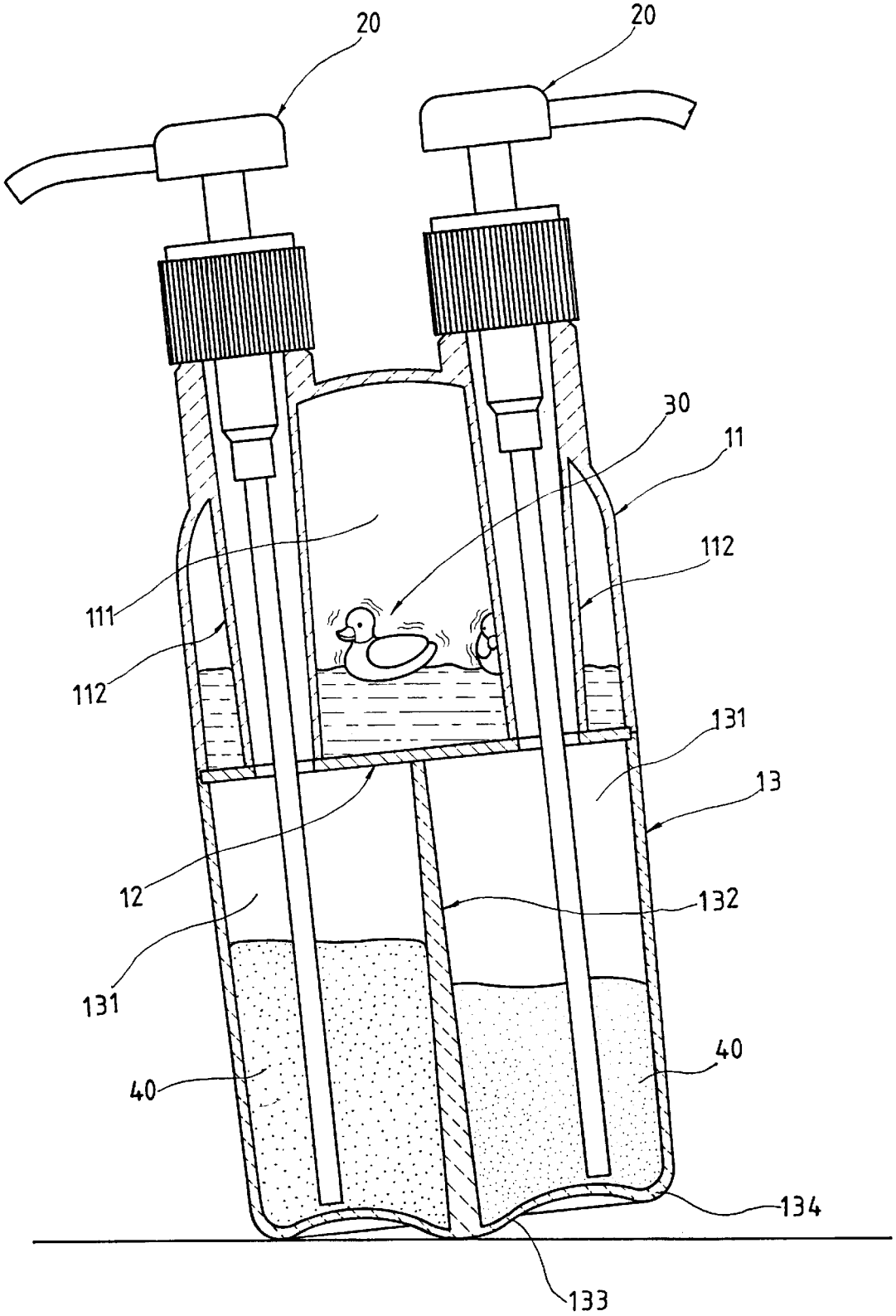
FIG. 6 is a vertical sectional view of a dual-dispenser bottle according to a third embodiment of the present invention with a dual-liquid ornament and two different types of milky lotion contained in the bottle.

FIG. 6 is a sectional view of a third embodiment of the bottle 10. In this embodiment, the bottom section 13 includes an upward curved bottom surface with a rounded center 133 thereof slightly downward projected beyond an outer lower periphery 134 of the bottom surface. That is, the bottom center 133 of the bottle 10 of FIG. 6 forms a central pivoting point of the bottle 10. Whenever a minor force is applied on the bottle 10, such as when a user depresses any one of the dispensers 20 in order to get some milky lotion 40 from the bottle 10, or when the user unintentionally touches the bottle 10, the bottle 10 tends to pivotally turn or swing for a short period of time, causing the dual-liquid ornament 30 in the first closed chamber 111 of the top section 11 to wave and show dynamic and changeful views.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A dual-dispenser bottle with dual-liquid ornament, comprising a top section, a bottom section, and a middle partition transversely connected to and between said top and said bottom sections; said top section, said bottom section, and said middle partition all being preferably individually integrally formed from transparent plastic material through injection molding and supersonically welded into one complete bottle unit; said bottle being characterized in that:

said top section is an open-bottomed shell and defines a first inner space in which two integrally formed and vertically spaced pipes are provided, said pipes having upward projected upper ends to form two mouths to each of which a dispenser is fitted, and lower open ends;

said middle partition includes two spaced holes such that when said middle partition is supersonically welded at an upper side to a bottom of said top section, said lower open ends of said pipes in said top section separately tightly abut on outer peripheries of said two holes on said middle partition for said first inner space to form a first closed chamber for containing a dual-liquid ornament therein; and that said bottom section is an open-topped shell and defines a second inner space in which a vertical partition is provided to divide the second inner space into two smaller spaces, such that when said bottom section is supersonically welded at its open top and a top of said vertical partition to a bottom side of said middle partition, said two smaller spaces form two second closed chambers into which two different types of milky lotion may be contained for dispensing via said dispensers.

2. A dual-dispenser bottle with dual-liquid ornament as claimed in claim 1, wherein said bottle is not necessarily limited to any specific design or shape, including individual heights of said top and said bottom sections, an inclination of said middle partitions relative to said top and said bottom sections, and diameters and/or locations of said two vertically spaced pipes in said top section.

3. A dual-dispenser bottle with dual-liquid ornament as claimed in claim 1, wherein said bottom section includes a curved bottom surface having a rounded center that slightly downward projects beyond an outer lower periphery of said bottom surface to form a central pivoting point of said bottle, whereby when a minor force is applied on said bottle, said bottle tends to pivotally turn or swing about said rounded bottom center for a short period of time, causing said dual-liquid ornament in said first closed chamber of said top section to wave and show dynamic and changeful views.

* * * * *